United States Patent [19]

Nelson

[11] 4,246,715

[45] Jan. 27, 1981

[54] TRAFFIC SIGNS

[76] Inventor: Mark E. Nelson, 3205 Heiden Cir., Lake Bluff, Ill. 60044

[21] Appl. No.: 80,009

[22] Filed: Sep. 28, 1979

[51] Int. Cl.[3] ..... G09F 15/00

[52] U.S. Cl. ..... 40/607; 40/530; 40/612

[58] Field of Search ..... 40/607, 606, 610, 612, 40/492, 530, 531, 533, 539

[56] References Cited

U.S. PATENT DOCUMENTS

| | | | |
|---|---|---|---|
| 2,090,783 | 8/1937 | Chinn | 40/610 |
| 2,120,418 | 6/1938 | Sorenson | 40/612 |
| 3,029,713 | 8/1962 | Hopson et al. | 404/11 |
| 3,250,032 | 10/1966 | Von Gal, Jr. et al. | 40/606 |
| 3,256,629 | 6/1966 | Whitman | 40/612 |
| 3,616,557 | 11/1971 | Vara, Sr. | 40/610 X |
| 3,677,511 | 7/1972 | Dicke | 40/610 X |
| 3,842,524 | 10/1974 | Drueck, Jr. | 40/617 X |
| 3,899,843 | 8/1975 | Doyle et al. | 40/602 |

*Primary Examiner*—John F. Pitrelli
*Assistant Examiner*—G. Lee Skillington
*Attorney, Agent, or Firm*—Newitt, Witcoff & McAndrews Allegretti

[57] ABSTRACT

An emergency warning traffic sign comprises a conventional stop sign which has been divided vertically in the middle into two sheet portions carrying portions of the message on one face of each of the sheet portions. The sheet portions are connected by a hinge such that a first of the portions may be mounted to a traffic signal post and the second sheet portion may be rotated between a first position in which the message is obscured to a second open message position. A locking bar is attached to the first sheet portion and is pivotally movable across the back of the sign and within its perimeter to lock the sign in both its open and closed positions. In a second embodiment of the invention, another sign carrying a different message is also divided vertically into a third and forth sheet portions and these sheet portions are hingedly connected to each other. The third sheet portion is stationarily mounted to the back of the second sheet portion such that the second sign with its message may be displayed when the first sign is folded and vice versa.

16 Claims, 9 Drawing Figures

TRAFFIC SIGNS

BACKGROUND AND SUMMARY OF THE INVENTION

This invention relates to traffic signs and, more particularly, to emergency traffic signs which may be closed in the absence of an emergency, but opened on the occurrence of an emergency.

Traffic signal lights fail at intersections with some frequency. When such failure occurs, it is usually necessary for police or road maintenance personnel to be dispatched to the scene either or both to direct traffic or to rig emergency warning signs. In the past warning signs have been cumbersome and difficult to install. Moreover, it is not uncommon for the person dispatched to the scene to be unable to find the necessary emergency signs when they must be used.

It is the purpose of the present invention to overcome these several disadvantages. The present invention is directed to an emergency traffic sign which may be permanently installed upon a fixed standard, such as upon the post upon which the traffic lights are mounted. Such permanent installation obviates the need for the emergency personnel to find and install the emergency sign because it is always at the scene. In traffic signs constructed in accordance with the principles of the present invention, the sign may be closed during normal traffic light operation, but easily opened to display its emergency message upon failure of the traffic lights. The signs constructed in accordance with the principles of the present invention are easy to use and make and are vandalproof, both in their open and closed positions. The signs contructed in accordance with the principles of the present invention are unobtrusive and unnoticeable when in their closed position, but may be easily and rapidly opened to their message communicating position in times of emergency. Moreover, the signs constructed in accordance with the principles of the present invention may be readily mounted using conventional sign mounting fixtures. In another feature according to the present invention, two signs may be present, one of which displays one message during normal traffic signal light operation. However, this sign may be rapidly and easily changed to convey a second message and cover the first message during times of signal light failure. One additional advantage of the last mentioned sign of the present invention, is that both signs take up no more vertical space than only a single sign.

In one principal aspect of the present invention, a sign comprises first and second flat sheet means, each said sheet means having a portion of a message on one face thereof, and the sheet means together containing an entire message. Hinge means couples the first and second sheet means together such that the one face of the first sheet means may be positioned in a first position in overlying relation to the one face of the second sheet means to cover all of the portions of the message and to a second position in which the one faces are in planar side by side relationship so as together to display the entire message. Locking means is mounted to one of the sheet means for pivoting thereon and is movable across the other face of at least one of the sheet means and substantially entirely within the perimeter of both sheet means between one location for locking both sheet means in the first position and another location for locking both sheet means in the second position.

In another aspect of the present invention, the locking means comprises an elongate bar means having a hole in its end opposite its pivotal end. Each of the sheet means also includes a hole therein, the hole in the bar means being alignable with both of the holes in the sheet means when the bar means is in the one location and with the hole in the other of the sheet means when the bar means is in the other location.

In still another aspect of the present invention, additional third and fourth sheet means may also be provided, each of which has a portion of a message on one face thereof and which together contain an entire message different than the first mentioned entire message. Second hinge means couples the third and fourth sheet means together such that one face of the fourth sheet means may be positioned in a third position in overlying relation to the one face of the fourth sheet means to cover all of the portions of the second mentioned message and into a fourth position in which one of the faces of the third and fourth sheet means are in planar side by side relationship to together display the entire second message. Locking means is pivotally movable between one location for locking the sheet means such that the second mentioned entire message is displayed and the first mentioned entire message is not and another location in which the first mentioned entire message is displayed and the second mentioned entire message is not.

These and other objects, features and advantages of the present invention will be fully understood upon a consideration of the following detailed description.

BRIEF DESCRIPTION OF THE DRAWINGS

In the course of this description the drawings will be frequently referred to in which.

DESCRIPTION OF THE PREFERRED EMBODIMENTS

Figure 1:
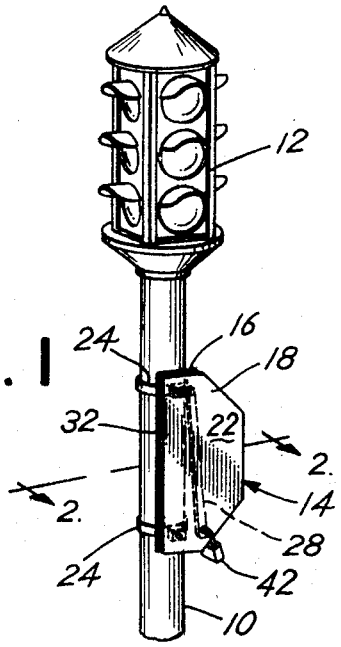
FIG. 1 shows a traffic signal light and a support post upon which one preferred embodiment of sign constructed in accordance with the principles of the present invention is shown in closed position and as viewed in the direction of oncoming traffic.
Figure 2:
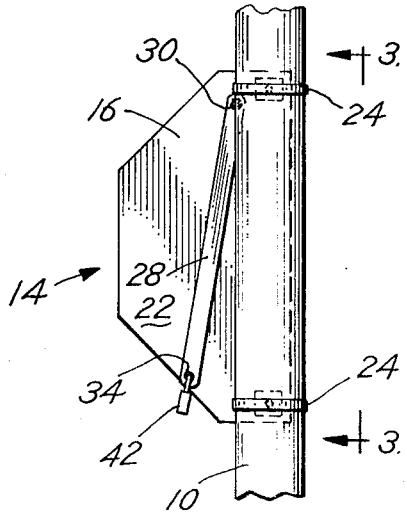
FIG. 2 is a rear elevation view of the sign as viewed along lines 2—2 of FIG. 1.
Figure 3:
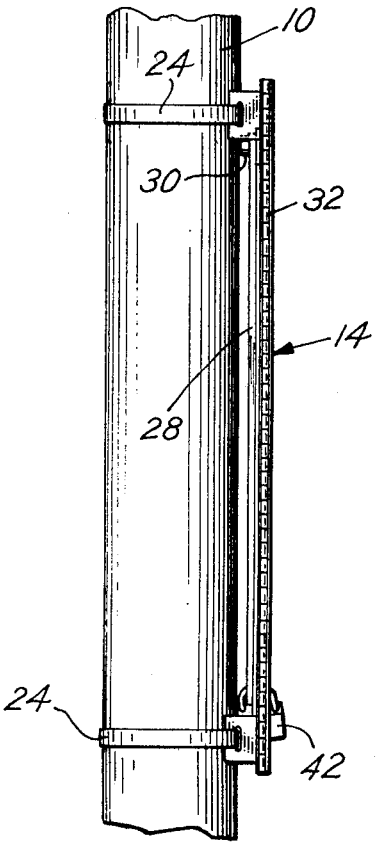
FIG. 3 is a side elevation view of the closed sign as viewed along lines 3—3 of FIG. 2.

One preferred embodiment of sign constructed in accordance with the principles of the present invention is shown in FIGS. 1-5. As shown in FIG. 1, the sign may be mounted on a standard signal post 10 upon which conventional, electrically operated, traffic signal lights 12 are mounted at the top thereof. When the signal lights 12 are in full operation, the emergency sign of the present invention is closed, as shown in FIGS. 1–3, but may be rapidly and easily opened upon failure of the signal lights 12 to the position shown in FIGS. 4–5.

Turning now to the sign 14 of the present invention, the sign preferably comprises a conventional octagonal stop sign which is cut vertically across to form two substantially flat sheet portions 16 and 18. Each of the sheet portions 16 and 18, thereby, contains a portion of the message which message portions together define an entire message. In the case of the sign shown in FIGS. 1–5, the sign is a conventional octagonal sign which conveys a "stop" message on the front faces 20 of the sign sheet portions 16 and 18. The rear faces 22 of the sign are preferably painted a neutral, unobstrusive color, such as forest green, so as to blend into the background and not confuse the driver when the sign is closed or when approaching from the rear of the sign.

Figure 4:
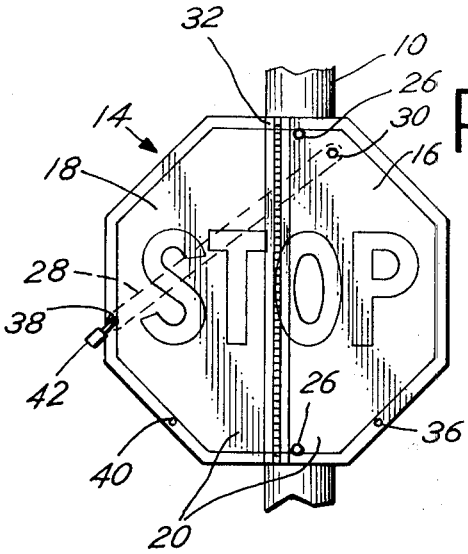
FIG. 4 is a front elevation view of the sign of FIG. 1, but in its open position.

The first portion 16 of the sign is stationarily mounted by conventional mounting straps and hangers 24 to the signal post 10 by way of bolts 26, as shown in FIG. 4, which extend through sheet portion 16 into the mounting hangers 24. An elongate rigid locking bar 28 is also pivotally mounted, as by bolt 30, to the rear face of sheet portion 16. The locking bar 28 is pivotally swingable about bolt 30 and in the space between the sign and post 10 across the back face of portion 16 when the sign is closed and across the back faces of both portions 16 and 18 when the sign is opened.

Figure 5:
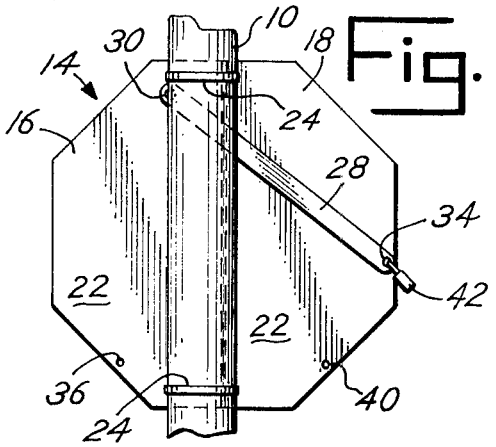
FIG. 5 is a rear elevation view of the sign shown in FIG. 4.

The second sheet portion 18 of the sign is connected along one of its edges to the complementary edge of sheet portion 16 by a suitable hinge, such as a piano hinge 32, to allow portion 18 to either be moved to a first position such that its front face 20 overlies the front face of the portion 16 in the sign closed position as shown in FIGS. 1–3, or into planar side by side relationship with portion 16 in the open position as shown in FIGS. 4–5.

The end of the elongate locking bar 28, opposite its pivot point 30, contains a hole 34 as shown in FIGS. 2 and 5. Sign portion 16 also contains a hole 36 and portion 18 contains holes 38 and 40 adjacent their edges as shown in FIG. 4. Hole 34 and the holes 36, 38, and 40 are positioned such that when sign 14 is closed, holes 36 and 40 are in alignment with each other and the hole 34 in the locking bar may be moved into alignment with holes 36 and 40 to receive a padlock 42, as shown in FIGS. 1–3, for locking all of the portions in their closed position. Conversely, when the sign is opened, the hole 34 in the locking bar 28 may be moved into alignment with the hole 38 in portion 18 to lock the sign in its open position.

Although it is believed from the foregoing description that the operation of the sign of the present invention will be clear, a brief description of the operation follows.

When the traffic lights 12 are operative, the sign will be in its closed position as shown in FIGS. 1–3 in which it displays no message. In this position movable sheet portion 18 has been moved about its hinge 32 such that its front face overlies the front face 20 of the stationary sheet portion 16. Locking bar 28 has been pivoted about its bolt 30 such that its hole 34 is in alignment with holes 36 and 40. In this position and when the padlock 42 is locked in place, the sign is held closed and secure against vandals.

When the signal lights fail and police or maintenance persons arrive on the scene, they will unlock padlock 42, preferably with a master key, and remove the padlock. Once the padlock is removed, sheet portion 18 may be pivoted about its hinge 32 to the open position shown in FIGS. 4–5 such that a complete "stop" message is displayed. When the sign has been opened, the locking bar 28 is pivoted across the back of the sign in the space between the sign and support post 10, until its hole 34 is in alignment with hole 38. In this location, the padlock 42 may be again inserted, this time through holes 34 and 38, and locked in place to prevent tampering with the sign.

A second preferred embodiment of invention is shown in FIGS. 6–9 in which like reference numerals have been used to designate elements similar to those previously described with respect to the embodiment shown in FIGS. 1–5. In this embodiment two signs carrying entirely different messages are part of the same assembly and the sign is capable of displaying either one or the other message at all times. This embodiment is particularly useful at intersections having traffic signals in which no turn can be made on red. This embodiment of sign is also particularly advantageous where the additional sign may be difficult or impossible to mount due to the presence of other signs. In this embodiment two messages are capable of being mounted on the post 10, yet no more vertical height is needed on the post 10 than for a single sign.

Figure 6:
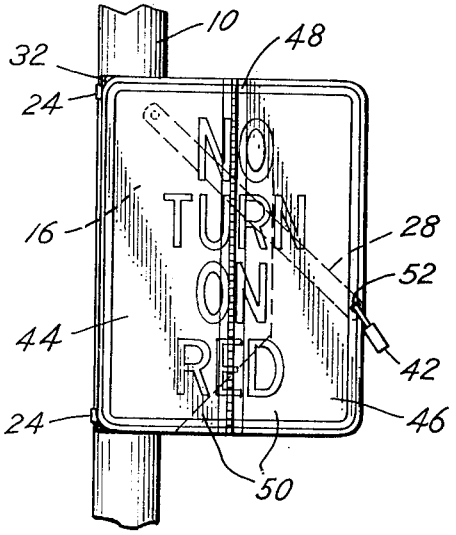
FIG. 6 is a front elevation view of a second preferred embodiment of sign constructed in accordance with the principles of the invention, and having two signs and in which one sign is displayed such as when the signal lights are functioning and a second sign is in its closed position.
Figure 7:
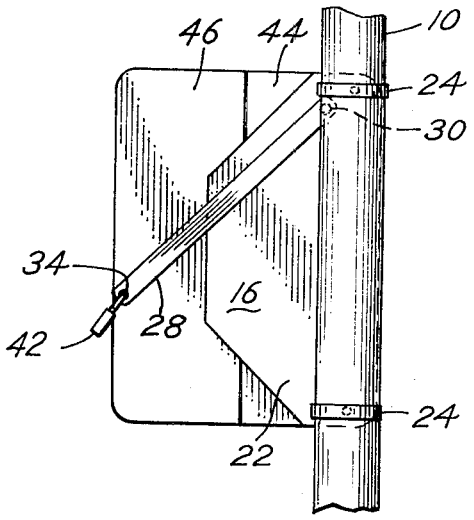
FIG. 7 is a rear elevation view of the sign shown in FIG. 6.
Figure 8:
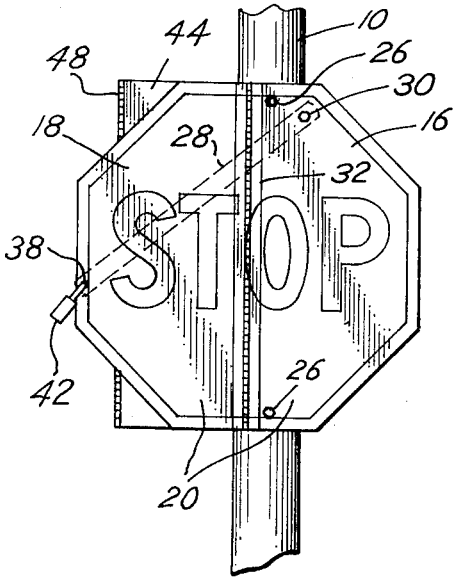
FIG. 8 is a front elevation view of the sign shown in FIG. 6, but in which the first sign has been closed and the second sign is being displayed such as when the signal lights are inoperative.
Figure 9:
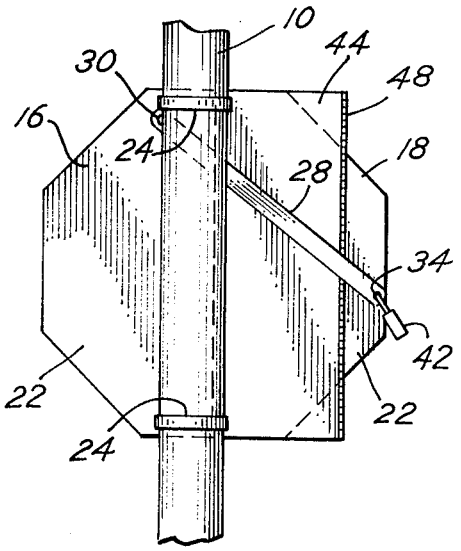
FIG. 9 is a rear elevation view of the sign shown in FIG. 8.

Referring particularly to FIGS. 8 and 9, the "stop" sign portion and locking bar in this embodiment are virtually identical to the "stop" sign and locking bar previously described in the embodiment shown in FIGS. 1–5, except that holes 36 and 40 may be eliminated from the "stop" sign sheet portions 16 and 18 respectively. In this embodiment a second sign, which may be a conventional "no turn on red" sign, is provided which is cut vertically to form third and fourth substantially flat sheet portions 44 and 46, respectively, as shown in FIGS. 6 and 7. Sheet portion 44 is stationarily attached to the movable portion 18 of the stop sign, such as by riveting, welding or the like. Sheet portion 44, in turn, is also attached along its vertically cut edge to the vertical edge of sheet portion 46 by a suitable hinge, such as a piano hinge 48 as shown in FIG. 6. Thus, sheet portion 46 may be rotated about hinge 48 between one position in which its message containing face 50 overlies the message face 50 of the sheet portion 44, or to its open position, as shown in FIGS. 6 and 7, in which the entire message is displayed and the sheet portions 44 and 46 are positioned in planar side by side relationship.

A hole 52 as shown in FIG. 6 is provided adjacent the edge of sheet portion 46 such that the hole 34 in the locking bar 28 may be moved into alignment with it.

The operation of this embodiment of the invention is as follows.

When the signal lights 12 are in operation, the "no turn on red" message is displayed indicating to the approaching traffic that there is no turn allowed on red at this particular intersection. In this condition the "stop" sign is closed and the "no turn on red" sign is displayed. The signs are locked in place by pivoting the locking bar 28 about its bolt 30 until the hole 34 in the locking bar is in alignment with hole 52 in sheet portion 46. When these holes are aligned, the padlock 42 may be inserted through the holes and locked in place to prevent tampering with the sign. It will be seen that in this locked position that the locking bar 28 extends across the back of the sign as shown in FIG. 7 to lock the "no turn on red" sign open and the "stop" sign closed. The traffic coming from the opposite direction will only see the rear faces of sheet portions 16, 44 and 46 which preferably are painted an unobtrusive color, such as forest green.

When failure of the traffic signals 12 occurs, the "no turn on red" sign is no longer necessary, but the emergency "stop" sign is. To reverse the signs, the padlock 42 is unlocked, freeing the movable sheet portion 46 of the "no turn on red" sign. Sheet portion 46 is then moved such that its message face 50 overlies the message face 50 of sheet portion 44. The "stop" sign is then opened by moving its sheet portion 18 about its piano hinge 32 along with the now folded "no turn on red" sheet portions 44 and 46 which are attached to the rear side of sheet portion 18 of the "stop" sign.

Once the "stop" sign has been opened, the locking bar 28 is pivoted to a new location about its bolt 30 such that it extends across the back of sheet portion 44 and sheet portion 18 of the "stop" sign until its hole 34 is in alignment with the hole 38 at the edge of the "stop" sign. The padlock may again be reinserted through the holes 34 and 38 and locked to prevent tampering with the sign in this "stop" configuration.

It will be understood that although the present invention has been described in terms of signs exhibiting "no turn on red" and/or "stop" messages, that the invention is not limited to these messages and may be readily employed to exhibit other messages. The embodiments of the present invention which have been described are merely illustrative of a few of the applications of the principles of the invention. Numerous modifications may be made by those skilled in the art without departing from the true spirit and scope of the invention.

What is claimed is:

1. A sign comprising first and second substantially flat sheet means, each said sheet means having a portion of a message on one face thereof and which together contain an entire message, hinge means coupling said first and second sheet means together such that said one face of said first sheet means may be positioned in a first position in overlying relation to said one face of said second sheet means to cover all said portions of said message thereon, and to a second position in which said one faces are in planar side by side relationship to together display the entire message, and locking means mounted to one of said sheet means for pivoting thereon and movable across the other face of at least one of said sheet means and substantially entirely within the perimeter of both said sheet means between one location for locking both said sheet means in said first position and another location for locking both said sheet means in said second position.

2. The sign of claim 1 wherein said hinge means couples an edge of said first sheet means to an edge of said second sheet means.

3. The sign of claim 1 wherein said locking means comprises rigid elongate bar means.

4. The sign of claim 3 wherein said bar means is pivotally attached to said one of said sheet means at one end and includes a hole at the other end, each of said sheet means also including a hole therein, the hole in said bar means being alignable with both of said holes in said sheet means when in said one location and with the hole in the other of said sheet means when in said another location.

5. The sign of claim 4 including padlock means extending through the hole in said bar means and the hole in the sheet means with which the first mentioned hole is aligned.

6. The sign of claim 1 including mounting means for stationarily mounting said first sheet means to a support and such that said second sheet means is mounted by said hinge means for movement between said first and second positions relative to said first sheet means.

7. The sign of claim 6 wherein said locking means comprises rigid elongate bar means.

8. The sign of claim 7 wherein said bar means is pivotally attached to said first sheet means at one end and includes a hole at the other end, each of said sheet means also including a hole therein, the hole in said bar means being alignable with both of said holes in said sheet means when in said one location and with the hole in said second sheet means when in said another location.

9. The sign of claim 8 including padlock means extending through the hole in said bar means and the hole in the sheet portions with which the first mentioned hole is aligned.

10. The sign of claim 1 wherein said sign is an octagonal stop traffic sign when said sheet means are in said second position.

11. The sign of claim 1 including third and fourth sheet means, each of said third and fourth sheet means having a portion of a message on one face thereof and which together contain an entire message different than the first mentioned entire message, second hinge means coupling said third and fourth sheet means together such that said one face of said fourth sheet means may be positioned in a third position in overlying relation to said one face of said third sheet means to cover all said portions of said second mentioned message thereon, and to a fourth position in which said one faces of said third and fourth sheet means are in planar side by side relationship to together display the entire second message, said locking means being pivotally movable between one location for locking said sheet means such that said second mentioned entire message is displayed and said first mentioned entire message is not and another location in which said first mentioned entire message is displayed and said second mentioned entire message is not.

12. The sign of claim 11 in which the faces of said second and third sheet means opposite their said one faces are attached together in face to face relationship.

13. The sign of claim 11 wherein said locking means comprises rigid elongate bar means.

14. The sign of claim 13 wherein said bar means is pivotally attached to said first of said sheet means at one end and includes a hole at the other end, said second and fourth sheet means also including a hole therein, the hole in said bar means being alignable with the hole in said fourth sheet means when in said one location and with the hole in said second sheet means when in said another location.

15. The sign of claim 14 including padlock means extending through the hole in said bar means and the hole in the sheet portions with which the first mentioned hole is aligned.

16. The sign of claim 11 including mounting means for stationarily mounting said first sheet means to a support and such that said second sheet means is mounted by said first mentioned hinge means for movement between said first and second positions relative to said first sheet means and said fourth sheet means is mounted by said second hinge means for movement between said third and fourth positions relative to said third sheet means.

* * * * *